United States Patent [19]

Stryjewski

[11] Patent Number: 4,501,482

[45] Date of Patent: Feb. 26, 1985

[54] MEMBER OF COMPLIANT MATERIAL

[75] Inventor: Walter A. Stryjewski, Hilton, N.Y.

[73] Assignee: Eastman Kodak Company, Rochester, N.Y.

[21] Appl. No.: 396,979

[22] Filed: Jul. 9, 1982

[51] Int. Cl.[3] ..... G03G 15/20

[52] U.S. Cl. ..... 355/3 FU; 29/132; 219/216; 219/469; 432/60

[58] Field of Search ..... 355/3 R, 3 FU; 219/216, 219/469, 470; 29/132; 432/60, 228; 428/328

[56] References Cited

U.S. PATENT DOCUMENTS

| | | | |
|---|---|---|---|
| 2,115,465 | 4/1938 | Merten | 29/132 |
| 3,452,181 | 6/1969 | Stryjewski . | |
| 3,866,572 | 2/1975 | Gundlach | 29/132 X |
| 3,902,845 | 9/1975 | Murphy . | |
| 3,937,919 | 2/1976 | Clerx et al. . | |
| 3,940,235 | 2/1976 | Weiler . | |
| 4,000,339 | 12/1976 | Murphy . | |
| 4,074,001 | 2/1978 | Imai . | |
| 4,075,390 | 2/1978 | Murphy | 428/328 X |
| 4,146,659 | 3/1979 | Swift et al. . | |
| 4,149,797 | 4/1979 | Imperial . | |
| 4,179,601 | 12/1979 | Tarumi et al. . | |
| 4,257,699 | 3/1981 | Lentz . | |
| 4,272,179 | 6/1981 | Seanor | 355/3 FU |

OTHER PUBLICATIONS

PLI.

Xerox Disclosure Journal, vol. 5, No. 2, Mar./Apr. 1980, pp. 163–164 and p. 189.

*Primary Examiner*—Fred L. Braun

*Attorney, Agent, or Firm*—Donald D. Schaper

[57] ABSTRACT

A member has a compliancy which changes at elevated temperatures. The member is useful as a fuser member such as a fuser roller for applying heat and pressure to a toner image carried by a receiver to fuse the image without introducing fuser-related image defects. The fuser member includes an elastomeric material incorporating particles of a material which is solid at ambient temperatures but which becomes fluid at fusing temperatures, thus making the elastomeric material more compliant.

22 Claims, 6 Drawing Figures

MEMBER OF COMPLIANT MATERIAL

BACKGROUND OF THE INVENTION

This invention relates generally to members whose compliancy increases at elevated temperatures. More particularly, this invention relates to members for fusing by heat and pressure toner particles to a receiver wherein the members include a layer of elastomer incorporating particles of eutectic material which are solid at ambient temperatures but which become fluid at fusing temperatures to effect a change in the compliancy of the member to prevent fuser-related image defects.

In processes involving contact of material by a member, it may be desirable to change the compliancy of the member during the operating cycle in order to prevent process-related defects in the material. For example, in electrographic copiers, toner images formed of thermoplastic toner particles are commonly fused to a receiver by means of pressure and heat applied in the nip of a roller fuser. Toner particles which are loosely held to a receiver prior to fusing must be maintained in their image-wise position during the fusing process so that movement of the particles and consequent image defects in the fused image do not result. Elastomer-covered fuser rollers cause localized stresses in the receiver material as it passes through the roller nip causing distortions in the toner image. Elastomeric layers which are more compliant tend to minimize such nip stresses and thus eliminate fuser-related image defects. Compliancy may be increased by making the elastomeric layers thicker and/or by using an elastomeric foam material. However, since a fuser roller is commonly heated internally, the elastomeric layer must be heat conductive in order to provide the necessary heat to fuse toner images on receivers coming into contact with the fuser roller. Fuser layers made of thick elastomeric layers or foam layers require an inefficient larger heat source to produce the same surface fusing temperature.

It is therefore desirable that a fuser member such as a fuser roller which fuses toner images to a receiver, through the application of heat and pressure, not cause defects in the fused images due to localized stresses produced during the fusing process. It is also desirable that the fuser member be made of a suitable material which permits efficient thermal conduction through the fuser layer when the member is heated internally.

SUMMARY OF THE INVENTION

According to the present invention, there is provided a member the compliancy of which changes at elevated temperatures and which is preferably thermally conductive. The member is especially suitable for use as a fuser member such as a fuser roller for applying heat and pressure to a toner image carried by a receiver to fuse the image without introducing fuser-related image defects. According to an aspect of the invention, the member includes an elastomeric material incorporating particles of a material which is solid at room temperatures but which becomes fluid at fusing temperatures, thus changing the compliancy of the elastomeric material at elevated fusing temperatures. The eutectic material is preferably heat conductive to improve the thermal conductivity of the member.

According to an aspect of the invention, a fuser roller is formed of a fusing layer including an elastomer incorporating particles which are solid at ambient temperatures but which melt at fusing temperatures to increase the compliance of the elastomeric layer.

According to another aspect of the invention, a foam member is formed by mixing into a base material particles which are porous or hollow of a material which is solid at ambient temperature but which becomes fluid at elevated temperatures. When the member is heated, gaseous medium contained in the gaseous pores of the particulate material is released to exist within the matrix of the base material to form a foam member. According to a further aspect of the invention, a fuser member is provided including an elastomer incorporating particles which are porous or hollow and which are solid at ambient temperatures but fluid at elevated temperatures. When the member is heated to fusing temperatures, a compliant foam elastomer having cavities containing liquid and gaseous medium is produced. The particles are preferably metallic to increase the heat conductivity of the foam layer.

According to a further aspect of the present invention, a multi-layer fuser member is provided having a first layer of elastomer material incorporating particles which may be solid or may be porous or hollow and which are of a material which is solid at ambient temperatures and a fluid at elevated temperatures; an intermediate layer of a material which is resistant to the absorption of fuser oil by the first layer and which is preferably reinforced with suitable fillers; and an outer elastomeric layer which is resistant to offset of toner and which is also preferably filled with atomized highly thermally conductive metallic particles.

The invention and its features and advantages will be set forth and become more apparent in the detailed description of the preferred embodiment presented below.

DESCRIPTION OF THE DRAWINGS

In the detailed description of the embodiments of the invention presented below, reference is made to the accompanying drawing, like numbers indicating like elements, in which.

DESCRIPTION OF THE PREFERRED EMBODIMENTS

Figure 1:
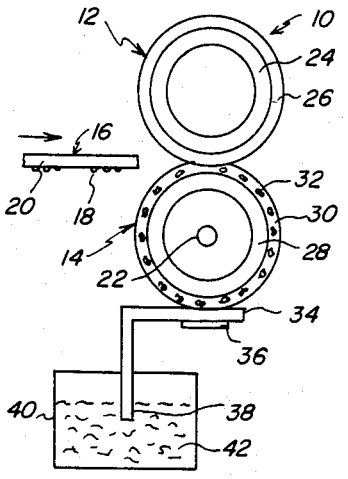
FIG. 1 is an elevational view of a roller fuser including a fuser roller according to the present invention having a layer incorporating eutectic particles.

Referring now to FIG. 1, there is shown a roller fuser incorporating a fuser roller according to the present invention. As shown, roller fuser 10 includes rollers 12 and 14, forming a pressure nip through which receiver 16 carrying toner image 18 on its lower side 20 passes to fuse the toner image to receiver 16. Roller 12 includes a cylindrical core 24 having layer 26 of high temperature-resistant material such as silicone elastomer or tetrafluoroethylene resin which prevents the sticking to it of toner or other debris from roller 14 or copy sheet 16. Fuser roller 14, according to the present invention, includes a cylindrical core 28 having an elastomer layer 30 incorporating eutectic particles 32 and at the center of core 28 a source of heat such as quartz lamp 22. Elastomer layer 30 is preferably of heat-resistant material which prevents to the sticking to it of toner and other debris. Such materials include silicone elastomer, fluorosilicone elastomer, the elastomer which is a copolymer of vinylidene fluoride and hexafluoropropylene and the fluoroelastomer which is a cross-linked copolymer of perfluoroalkyl perfluorovinyl ether and tetrafluoroethylene. As an example, the elastomeric layer 30 may comprise a room temperature vulcanizable (RTV) dimethyl silicone elastomer which has a thickness of 0.050 to 0.100 inches. The fusing surface of layer 30 may be heated by lamp 22 to a temperature of 150° C. to 200° C. depending upon the melting point of the toner material to be fused. In order to increase the anti-sticking properties of this layer, a fuser release material such as silicone fuser oil is applied to the surface of elastomeric layer 30 by means of a wick 34 on bracket 36 which has an end 38 projecting into sump 40 of fuser oil 42.

As copy sheet 16 with unfused toner image 18 passes through the nip formed by rollers 12 and 14, toner image 18 is contacted by heated fuser roller 14 and is permanently fixed to copy sheet 16 through the application of heat and pressure. The toner offset preventing characteristics of layer 30 and the fuser oil applied to the surface of layer 30 prevents toner and other debris from copy sheet 16 from offsetting onto the surface of roller 14 and prevents sticking of copy sheet 16 to roller 14.

Figure 2:
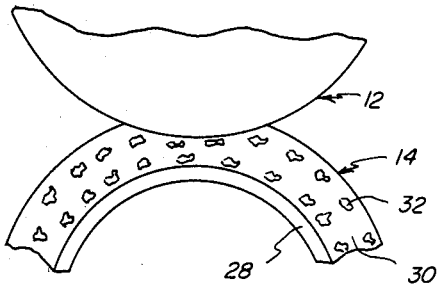
FIG. 2 is a partially sectional elevational view of the roller fuser of FIG. 1, showing the fuser roller at ambient temperature and the eutectic particles in a solid state.
Figure 3:
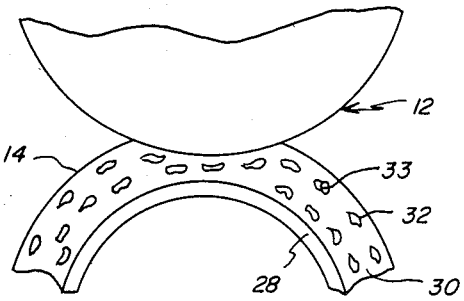
FIG. 3 is a partially sectional elevational view similar to FIG. 2 but showing the fuser member heated to fusing temperatures at which the eutectic particles become fluid.

Referring now to FIGS. 2 and 3, there is shown in more detail the structure and functioning of layer 30 of roller 14. As shown, layer 30 comprises an elastomer of high temperature-resistant material such as silicone elastomer which incorporates particles 32 of eutectic material which are solid at ambient temperatures but which become fluid at fusing temperatures. The particular material to be used will depend upon the melting point of the toner to be fused. A suitable material is the eutectic alloy mixture of 63% lead and 37% tin which melts at a temperature of 361° F. (183° C.) and which is used with toner material which melt at about 370° F. (188° C.). Any other material may be used which has the desired characteristics such as other eutectic materials; metals, such as Indium, Lithium, etc. which have melting points of suitable toner materials; and non-metallic materials such as thermoplastics. As shown in FIG. 2, the particles 32 are in a solid state and elastomeric layer 30 is deformed by roller 12 due to the pressure (by means not shown) exerted between roller 12 and roller 14. In FIG. 3, fusing layer 30 has been heated to fusing temperatures and particles 32 of eutectic material have melted to form liquid pools in voids 33 produced by particles 32 when layer 30 was formed. Thus, layer 30 is more compliant due to the liquifying of material 32, and the nip formed between roller 12 and 14 is extended.

As rollers 12 and 14 rotate and a copy sheet 16 carrying an unfused toner image passes through the roller nip, the liquid pockets conform to the elastomeric matrix allowing the portion of elastomeric layer 30 in contact with roller 12 to deform more easily and comply with the surface of the toned copy sheet 16. Because the elastomeric matrix is in a quasi fluidic state, it effectively flows through the nip formed by rollers 12 and 14 with decreased viscosity. Stresses caused by nip pressure on copy sheet 16 are minimized, thus minimizing deformation of the toner image as it is fused to sheet 20. Fuser-related image defects are consequently eliminated. Moreover, the thermal conductivity of the liquid metallic pools permits the thickness of elastomeric layer 30 to be increased so that stress differences between thicker (copy image areas) and thinner (copy sheet only) areas are minimized. Thicker elastomeric layers also reduce the differential torques normally induced across the length of the roller. Moreover, longer roller nips may be effected at lower values of pressure engagement between rollers 12 and 14.

Figure 4:
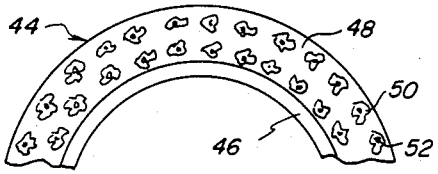
FIG. 4 is a partially sectional elevational view of another embodiment of fuser member according to the present invention at ambient temperatures.
Figure 5:
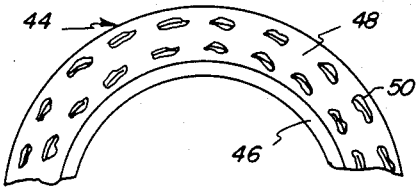
FIG. 5 is a partially sectional elevational view of the embodiment of FIG. 4 at fusing temperatures; and, FIG. 6 is a partially sectional elevational view of another embodiment of a fuser member according to the present invention.

Referring now to FIGS. 4 and 5, there is disclosed another embodiment of the present invention as incorporated into a fuser member. Foamed elastomers such as foamed silicone elastomers have been found to minimize fuser-related image defects. However, in foaming the elastomer, thermal conductivity is reduced due to the thermal insulative effects of the gaseous cavities in the elastomeric layer. Thus, if a foam elastomer layer is used, a larger thermal energy source must be provided inside the fuser roller to compensate for the decrease in thermal conductivity of the foam layer. According to the present invention, a foamed elastomer with good thermal conductivity is produced by incorporating into the elastomer eutectic particles which are either porous or hollow and which are solid at ambient temperatures but which are fluid at elevated temperatures. Heating of the elastomer above the temperature at which the particulate material melts creates a foam layer having cavities which are filled partially with fluid material and partially with gaseous medium which had been trapped in the pores or hollow portions of the eutectic particles. When the elastomer is cooled to ambient temperature, the melted material solidifies in the lower part of the cavity and the gaseous medium fills the upper part of the cavity. The so-formed foam elastomer may be used at temperatures either below or above the melting point of the particulate material. In the former case, the partially gaseous cavities will give a foam characteristic to the elastomer increasing its compliance while the solidified material increases the thermal conductivity of the elastomer.

As shown in FIG. 4, fuser roller 44 includes a core 46 of heat conductive material and an elastomeric layer 48 incorporating eutectic particles 50 having hollow portion 52. The eutectic particles are shown solid since roller 44 is at ambient temperature. In FIG. 5, eutectic particles 50 have been heated above their melting point to a fluid state. Elastomeric layer 48 has become a foam structure having cavities filled partially with fluid material and partially with gaseous medium. At fusing temperatures, increased compliance of layer 48 results not only from the fluidic eutectic material but also from the gaseous medium thus minimizing stress on a copy sheet passed through the roller fuser nip. The thermal conductivity of the foam layer is increased through the use of heat conductive particulate material.

Figure 6:
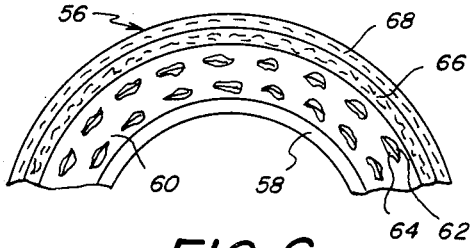

Referring now to FIG. 6, there is shown another embodiment of the present invention. When an elastomer has fuser oil of similar chemical composition applied to it, such as when silicone oil is applied to silicone elastomer, there is a tendency for the elastomer to absorb the fuser oil causing swelling of the elastomer and degradation of the fuser roller. Such degradation results in early onset of fuser-related image defects in fused copy sheets and consequent shortened roller life. In the embodiment of FIG. 6, a segment of fuser roller 56 is illustrated including a heat conductive core 58 of aluminum for the like. A first layer of silicone elastomer 60 incorporates hollow eutectic particles which when melted form cavities 62 in the elastomer layer partially filled with eutectic material 64 and partially filled with gaseous medium. In order to prevent absorption of silicone fuser oil by silicone elastomer layer 60, a barrier layer 66 is provided of suitable material which is resistant to absorption of fuser oil absorbed by layer 60. Suitable materials include the elastomer comprising a copolymer of vinylidene fluoride and hexafluoropropylene (sold under the trade name, "VITON" by DuPont, Wilmington, Del.), fluorosilicone elastomer and the fluoroelastomer which is the cross-linked copolymer of perfluoroalkyl perfluorovinyl ether and tetrafluorethylene. Layer 66 may incorporate fillers to make the layer more rigid and more thermally conductive. An outer layer 68 is provided of silicone elastomer which may be filled with microparticles of highly conductive metallic material to further reinforce the outer surface.

Although the invention has been described above with respect to fuser rollers, it will be understood that other configurations of fuser members may be used. Thus, the fuser member may comprise a flat plate including an elastomeric layer incorporating particles of material which are solid at ambient temperatures but which are fluid at fusing temperatures. The fuser member may also comprise a continuous belt formed of a flexible base layer overcoated with at least one layer of elastomer having particles of material with suitable melting points. Moreover, the scope of the present invention is not to be limited to only fuser members. The present invention generally provides method and apparatus for selectively changing the compliancy of elastomer or flexible members at elevated temperatures by providing an elastomeric or flexible segment incorporating a suitable material which becomes fluid above a predetermined temperature.

The present invention also provides a method for forming foam elastomer or flexible materials which may be heat conductive by incorporating into the material particles of material which are porous or hollow and which becomes fluid at elevated temperatures. Thus, when the material is heated to the melting point of the particulate material, the gaseous medium is released from pores to produce a foam material. Additionally, at temperatures above the melting point of the particulate material, the cavities of the foam material are partially filled with liquid to increase the compliance of the material at elevated temperatures. Thermal conductivity of the material is increased by the use of thermally conductive particles.

The invention has been described in detail with particular reference to preferred embodiments thereof; however, it will be understood that variations and modifications can be effected within the spirit and scope of the invention.

What is claimed:

1. A member whose compliancy changes at elevated temperatures comprising:

a compliant layer incorporating enclosed particles of material which are solid at ambient temperatures, which are fluid above a predetermined temperature the fluid being contained within voids in said compliant layer formed by said particles to increase the compliancy of the member above such temperature, and which are resolidified within said voids when the material is cooled below said predetermined temperature.

2. The member of claim 1 wherein said particles comprise heat-conductive particles.

3. The member of claim 1 wherein said particles are porous or hollow and wherein said voids within said compliant layer contain fluid which is partially gaseous and partially liquid above said predetermined temperature.

4. The member of claim 1 including a base layer of heat conductive material and a layer of compliant material incorporating particles which are heat-conductive.

5. A member for fusing toner particles to a receiver by means of heat and pressure, said member comprising:

a compliant layer incorporating enclosed particles of material which are solid at non-fusing temperatures, which are fluid when heated to fusing temperatures, the fluid being contained within voids in said compliant layer formed by said particles to increase the compliancy of said compliant material at such fusing temperatures and which are resolidified within said voids when the material is cooled below said fusing temperatures such that said material is not consumed during fusing.

6. The member of claim 5 wherein said particles of material are heat conductive.

7. The member of claim 6 wherein said particles of material includes an alloy of lead and tin.

8. The member of claim 5 wherein said particles of material are porous or hollow and wherein said voids in the compliant layer contain fluid which is partially gaseous and partially fluid at fusing temperatures.

9. The member of claim 5 wherein said compliant layer is an elastomer which is resistant to degradation at high temperatures.

10. A member for fusing toner particles to a receiver by means of heat and pressure, said member comprising:

a compliant layer incorporating particles of material which are solid at non-fusing temperatures and fluid when heated to fusing temperatures to increase the compliancy of said compliant layer at such fusing temperaturs wherein said particles of material comprise a heat-conductive alloy of lead and tin.

11. A fuser roller for fusing toner particles to a receiver through the application of heat and pressure, said roller comprising:

a cylindrical core; and an elastomeric layer on said core, said layer incorporating enclosed particles of material which are solid at non-fusing temperatures, which are fluid when heated to fusing temperatures, the fluid being contained in voids in said elastomeric layer formed by said particles to increase the compliancy of said elastomeric material at said fusing temperatures and which are resolidified within said voids when the material is cooled below said fusing temperatures such that said material is not consumed during fusing.

12. The fuser roller of claim 11 wherein said core is of heat-conductive material and said particles are of heat-conductive material.

13. The fuser roller of claim 11 wherein said particles are porous or hollow and wherein said voids in said elastomeric layer contain gaseous medium at fusing temperatures to form a foam elastomer.

14. The fuser roller of claim 11 further including a layer of material on said elastomeric layer which is resistant to the absorption of fuser oil which is absorbed by the elastomeric layer.

15. The fuser roller of claim 14 wherein said elastomeric layer comprises silicone elastomer and wherein said fuser oil-resistant layer comprises a fluoroelastomer which is resistant to absorption of silicone fuser oil applied to the fuser roller.

16. The fuser roller of claim 15 wherein said fluoroelastomer of said fuser oil resistant layer includes fluorosilicone elastomer, the elastomer comprising a copolymer of vinylidene fluoride and hexafluoropropylene and the elastomer comprising a cross-linked copolymer of perfluoroalkyl perfluorovinyl ether and tetrafluoroethylene.

17. The fuser roller of claim 16 including an outer layer of silicone elastomer on said oil-resistant layer.

18. The fuser roller of claims 14, 15, 16 or 17 wherein said oil-resistant layer includes heat-conductive filler particles.

19. The method for producing a foam fuser member comprising:

mixing into a compliant base material which is to be foamed particles which are porous or hollow and which are solid at ambient temperatures and fluid at elevated temperatures;

forming the mixture into the fuser member;

heating the so-formed member to melt the particles to produce enlcosed cavities containing gaseous medium and liquid medium; and cooling the so formed member to ambient temperature to resolidify the particulate material in the lower part of the cavities with the gaseous medium filling the upper part of the cavities to produce a foam member.

20. The method of claim 19 wherein said particles comprise heat-conductive particles.

21. The method of claim 20 wherein said base material is formed of a high-temperature-resistant elastomer including silicone elastomer, fluorosilicone elastomer, the elastomer comprising a copolymer of vinylidene fluoride and hexafluoropropylene and the elastomer comprising a cross-linked colpolymer of perfluoroalkyl perfluorovinyl ether and tetrafluoroethylene.

22. The method of claim 20 wherein said heat-conductive particles are eutectic metallic particles which melt at fusing temperatures of about 100° to 200° C.

* * * * *